US011123751B2

(12) United States Patent
Damak et al.

(10) Patent No.: US 11,123,751 B2
(45) Date of Patent: Sep. 21, 2021

(54) PANELS FOR USE IN COLLECTING FLUID FROM A GAS STREAM

(71) Applicant: Infinite Cooling Inc., Somerville, MA (US)

(72) Inventors: Maher Damak, Cambridge, MA (US); Karim Khalil, Boston, MA (US); Kevin Simon, Somerville, MA (US); Kripa Varanasi, Lexington, MA (US); Joseph DiPrisco, Reading, MA (US)

(73) Assignee: Infinite Cooling Inc., Somerville, MA (US)

( * ) Notice: Subject to any disclaimer, the term of this patent is extended or adjusted under 35 U.S.C. 154(b) by 0 days.

(21) Appl. No.: 16/917,658

(22) Filed: Jun. 30, 2020

(65) Prior Publication Data

US 2021/0031213 A1 Feb. 4, 2021

Related U.S. Application Data

(60) Provisional application No. 62/881,691, filed on Aug. 1, 2019.

(51) Int. Cl.
*B03C 3/45* (2006.01)
*B03C 3/41* (2006.01)

(52) U.S. Cl.
CPC . *B03C 3/45* (2013.01); *B03C 3/41* (2013.01)

(58) Field of Classification Search
CPC combination set(s) only.
See application file for complete search history.

(56) References Cited

U.S. PATENT DOCUMENTS 1,343,482 A 6/1920 Schmidt et al.
1,994,259 A * 3/1935 Thorne ..... B03C 3/70 174/31 R (Continued)

FOREIGN PATENT DOCUMENTS

CN 205341043 U * 6/2013 ..... B03C 3/16
KR 101460663 B1 11/2014

(Continued)

OTHER PUBLICATIONS

Chrzan, K. L. and Streubel, H., Artificial Rain Test of Outdoor Long Rod Insulatators, Proceedings of the 16th International Symposium on High Voltage Engineering, ISBN:978-0-620-44584-9, Paper E-31:1-5, (2009).

(Continued)

*Primary Examiner* — Christopher P Jones
*Assistant Examiner* — Sonji Turner
(74) *Attorney, Agent, or Firm* — Choate, Hall & Stewart LLP; Kristen C. Buteau; Michael D. Schmitt

(57) ABSTRACT

An example of a panel for use in collecting fluid in a gas stream includes a fluid collection member comprising one or more collection electrodes. The panel may include an emitter electrode assembly member comprising an emitter electrode frame and one or more emitter electrodes attached to the emitter electrode frame (e.g., disposed in a one- or two-dimensional array). The one or more emitter electrodes may be physically separated from the one or more collection electrodes. The fluid collection member may be physically connected to the emitter electrode assembly member. The one or more collection electrodes may be electrically insulated from the one or more emitter electrodes.

21 Claims, 12 Drawing Sheets

(56) References Cited

U.S. PATENT DOCUMENTS 2,264,428 A * 12/1941 Austin ..... H01B 17/36 174/30
2,588,111 A * 3/1952 Hanneman ..... B03C 3/45 204/668
2,708,488 A * 5/1955 Larsson ..... B03C 3/41 96/96
2,987,137 A 6/1961 Brixius et al.
3,040,497 A 6/1962 Schwab
3,257,501 A * 6/1966 Sauer ..... H01B 17/26 174/143
3,309,477 A * 3/1967 Bronikowski ..... H01H 85/0241 337/158
3,315,026 A * 4/1967 Gregory ..... H01B 17/12 174/139
3,600,653 A * 8/1971 Hall ..... B03C 9/00 95/62
3,604,830 A * 9/1971 Frakes ..... H01B 17/34 174/31 R
3,755,611 A * 8/1973 Queck ..... B03C 3/70 174/31 R
3,773,966 A * 11/1973 Ebert ..... B03C 3/70 96/50
3,816,980 A 6/1974 Schwab
3,851,702 A 12/1974 Heller et al.
3,923,935 A 12/1975 Cates
3,934,817 A 1/1976 Barry et al.
3,966,436 A * 6/1976 Archer ..... B03C 3/41 96/91
3,972,701 A * 8/1976 Teel ..... B03C 3/40 96/88
4,045,604 A * 8/1977 Clabburn ..... B29C 63/42 428/35.1
4,098,854 A 7/1978 Knirsch et al.
4,102,038 A * 7/1978 Eagan ..... B03C 3/86 29/462
4,117,255 A * 9/1978 Kawaike ..... H01B 17/26 174/211
4,133,653 A 1/1979 Soltis
4,249,391 A 2/1981 Taylor
4,279,625 A 7/1981 Inculet et al.
4,294,591 A * 10/1981 Kahl ..... B03C 3/70 174/211
4,303,418 A * 12/1981 Coe, Jr. ..... B03C 3/41 96/86
4,360,366 A 11/1982 Collins et al.
4,440,975 A * 4/1984 Kaczerginski ..... H01B 17/32 174/209
4,502,872 A * 3/1985 Ivester ..... B03C 3/41 96/90
4,514,344 A 4/1985 Ruscheweyh
4,634,806 A * 1/1987 Haag ..... B03C 3/70 174/211
4,662,902 A 5/1987 Meyer-Pittroff
4,670,026 A 6/1987 Hoenig
4,670,625 A * 6/1987 Wood ..... H01B 17/301 174/142
4,700,014 A * 10/1987 Joy ..... H01B 17/52 174/31 R
4,714,800 A * 12/1987 Atkins ..... H02G 15/068 174/73.1
4,715,870 A 12/1987 Masuda et al.
4,724,284 A * 2/1988 Wheeler ..... B29C 65/66 156/294
4,749,824 A * 6/1988 Orbeck ..... H01B 17/32 174/179
4,905,118 A * 2/1990 Sakich ..... H01C 7/126 174/178
4,965,407 A * 10/1990 Hamm ..... H01B 17/26 174/142
5,147,423 A * 9/1992 Richards ..... B03C 3/38 96/62
5,264,014 A 11/1993 Lannefors et al.
5,275,643 A 1/1994 Usui
5,407,171 A 4/1995 Gonzalez
5,448,019 A * 9/1995 Berlovan, Jr. ..... H01B 17/12 174/141 R
5,449,036 A 9/1995 Genge et al.
5,986,216 A * 11/1999 Krause ..... H01B 17/18 174/179
6,096,119 A 8/2000 Ho et al.
6,152,378 A 11/2000 Alekseevich et al.
6,156,104 A 12/2000 Jeong
6,302,944 B1 10/2001 Hoenig
6,303,870 B1 * 10/2001 Nazaryan ..... H01B 17/00 174/155
6,423,903 B1 * 7/2002 Tapani ..... H01H 33/24 174/138 R
6,441,310 B1 * 8/2002 Niedermier ..... H01B 17/325 174/137 A
6,501,029 B1 * 12/2002 Guillemette ..... H01B 17/325 174/137 B
6,576,046 B2 6/2003 Pruette et al.
6,679,940 B1 1/2004 Oda
6,872,238 B1 * 3/2005 Truce ..... B01D 49/00 95/29
7,485,174 B2 * 2/2009 Wang ..... B03C 3/09 96/79
8,337,600 B2 12/2012 Paur et al.
8,425,657 B2 4/2013 Ursem et al.
8,729,396 B2 * 5/2014 Zhang ..... C08J 5/04 174/138 C
9,073,079 B2 7/2015 Schulze et al.
9,308,537 B2 * 4/2016 Krichtafovitch ..... B03C 3/09
9,789,494 B2 10/2017 Wiser, III et al.
2002/0134665 A1 * 9/2002 Taylor ..... B03C 3/32 204/164
2006/0130658 A1 6/2006 Chang et al.
2007/0063361 A1 3/2007 Palmer
2011/0203459 A1 8/2011 Swoboda et al.
2011/0227236 A1 9/2011 Vouche et al.
2012/0180512 A1 7/2012 Laing et al.
2013/0047857 A1 2/2013 Bohlen
2013/0228941 A1 9/2013 Bogh et al.
2014/0260987 A1 9/2014 Park et al.
2015/0290352 A1 10/2015 Ota et al.
2015/0360235 A1 * 12/2015 Ueda ..... B03C 3/41 95/57
2015/0375237 A1 12/2015 Kojima et al.
2017/0354978 A1 * 12/2017 Krichtafovitch ..... B03C 3/12
2017/0354979 A1 * 12/2017 Krichtafovitch ..... B03C 3/368
2018/0078950 A1 * 3/2018 Sato ..... B03C 3/41
2018/0272358 A1 9/2018 Damak et al.
2019/0039077 A1 * 2/2019 Jeon ..... B03C 3/47
2019/0351431 A1 * 11/2019 Krichtafovitch ..... B03C 3/86
2020/0353480 A1 11/2020 Lee et al.
2020/0360935 A1 11/2020 Lee et al.
2020/0368757 A1 11/2020 Lee et al.
2020/0368760 A1 11/2020 Lee et al.
2021/0031212 A1 2/2021 Damak et al.

FOREIGN PATENT DOCUMENTS

RU 2494326 C1 9/2013
RU 2503501 C1 1/2014
WO WO-98/57750 A1 12/1998
WO WO-2017/058949 A1 4/2017
WO WO-2021/021369 A1 2/2021
WO WO-2021/021370 A1 2/2021

OTHER PUBLICATIONS

Daal, L. et al., Evaluation of different water vapor capture technologies and energy modeling results for membrane technology, Icapwa, DNV-KEMA the Netherlands, Department PGR-PCW, P.O. Box 9035, 6800 ET Arnhem, The Netherlands, Combined Paper ID: 186 & 192, 21 pages, (2012).

(56) References Cited

OTHER PUBLICATIONS

Kraemer, H. and Johnstone, H.F., Collection of Aerosol Particles in Presence of Electrostatic Fields, Industrial and Engineering Chemistry, 47(12):2426-2434 (1955).
Levy, E. et al., Recovery of Water From Boiler Flue Gas—Final Technical Report, 97 pages (dated Dec. 2008).
Lindahl, P. et al., Plume Abatement—The Next Generation, Cooling Technology Institute, Presented at the 2010 Cooling Technology Institute Annual Conference, 10 pages (Feb. 7-11, 2010).
Tyagi, S.K. et al., Formation, potential and abatement of plume from wet cooling towers: A review, Renewable and Sustainable Energy Reviews, 16:3409-3429 (2012).
Uchiyama, H. and Jyumonji, M., Field experiments of an electrostatic fog-liquefier, Journal of Electrostatics, 35:133-143 (1995).
International Search Report for PCT/US2020/040346 (Systems and Methods for Collecting Fluid From a Gas Stream, filed Jun. 30, 2020) received from ISA/EP, 5 pages (dated Oct. 14, 2020).
Uchiyama, H. and Jyumonji, M., Development of an Electrostatic Fogliquefier and its Field Experiments, Japanese Journal of Applied Physics, Japan Society of Applied Physics, 28(11): the whole document (1989).
Written Opinion for PCT/US2020/040346 (Systems and Methods for Collecting Fluid From a Gas Stream, filed Jun. 30, 2020) received from ISA/EP, 14 pages (dated Oct. 14, 2020).
International Search Report for PCT/US2020/040350 (Panels for Use in Collecting Fluid From a Gas Stream, filed Jun. 30, 2020) received by ISA/EP, 7 pages (Dec. 11, 2020).
Written Opinion for PCT/US2020/040350 (Panels for Use in Collecting Fluid From a Gas Stream, filed Jun. 30, 2020) received by ISA/EP, 13 pages (dated Dec. 11, 2020).

* cited by examiner

PANELS FOR USE IN COLLECTING FLUID FROM A GAS STREAM

PRIORITY APPLICATION

This application claims the benefit of U.S. Provisional Patent Application No. 62/881,691, filed on Aug. 1, 2019, the disclosure of which is hereby incorporated by reference herein in its entirety.

TECHNICAL FIELD

This disclosure relates generally to panels that can be used for collecting fluid from a gas stream.

BACKGROUND

Cooling towers use evaporative cooling where a portion of a circulating hot water is evaporated to cool the rest of the water due to the latent heat of evaporation. The generated vapor is then released to the atmosphere and is lost. Often, when some weather conditions are met, the exiting vapor condenses into fog as it leaves the cooling tower and forms a visible white plume. This plume is undesirable because of reduced visibility effects, and additional plume abatement systems are incorporated into the tower to prevent it from forming. Water losses due to evaporation are significant and represent an important part of operating costs for a cooling tower.

Cooling towers use large quantities of water because they have to make up for the water losses they incur. Water is lost in three ways. Evaporation is the main water loss: once water is converted into vapor to reject heat, the generated vapor is released into the ambient air where it is permanently lost. The second source of water loss is blowdown, which is the water that has to be removed from the tower and replaced to prevent fouling and scale formation. The blowdown volume depends on the cycles of concentration, i.e., the number of times solids are concentrated in the circulating water compared to make-up water. Finally, some water is lost due to drift, which means small droplets getting entrained with the exiting air/vapor flow. Drift losses are usually minimal (~1% of the consumption).

It may be desirable to abate plume from gas outlets in certain cases. For example, regulatory requirements relating to safety (drifting plumes can reduce visibility on roads and airports) and aesthetics, force some cooling towers to be equipped with plume abatement systems, which generally heat the exiting vapor and decrease its moisture content, either by heat exchangers or by blowing hot dry air and mixing it with the exiting vapor, thereby preventing the formation of fog droplets at the outlet of the tower. These abatement systems are able to remove the appearance of the plume, however the plant consumes the same amount of water, and lowers its overall net energy efficiency due to the added heat it has to create/redirect to the cooling tower outlets.

There are needs, therefore, to reduce the amount of water lost by cooling towers and to abate plumes formed by cooling towers.

SUMMARY

The present disclosure describes, inter alia, panels for use in collecting fluid from gas streams. In some embodiments, panels can be used in systems which make use of spontaneous fog formation to abate plumes while simultaneously collecting fluid droplets, thereby reducing fluid losses for the system. For example, a collection panel may be used at the outside of a cooling tower to abate plumes and collect fluid (e.g., water) dispersed therein. The collected fluid can be reused in any number of ways. For example, collected water can be used as make-up water for the cooling tower, therefore considerably reducing water consumption of cooling towers. The gas streams may be, for example, air streams. The fluid may be, for example, water (e.g., derived from brackish water or seawater). Examples of applications where fluid may be collected from a gas stream using panels disclosed herein include, but are not limited to, cooling towers, chimneys, steam vents, steam exhausts, HVAC systems, and combustion exhausts. Panels described herein can be used to collect fluid near an outlet for a gas stream (e.g., an outlet of a cooling tower) or in the middle of a gas stream (e.g., somewhere along a duct of exhaust or other HVAC system).

A panel may include one or more collection electrodes and one or more emitter electrodes. The emitter electrode(s) are operable to maintain an applied voltage to cause fluid to be deposited on collection electrode(s) at a higher rate than would be deposited on the collection electrode(s) without the applied voltage. In some embodiments, applying a voltage at emitter electrode(s) creates a corona discharge that charges fluid in a passing gas stream and amounts of the charged fluid are then attracted to and collected on fluid collection electrode(s). An electric field generated due to the applied voltage may further promote movement of the charged fluid. Use of emitter electrodes in combination with collection electrodes to collect fluid from a gas stream is described in U.S. patent application Ser. No. 15/763,229, filed on Mar. 26, 2018, the content of which is hereby incorporated by reference in its entirety.

An example of a panel for use in collecting fluid in a gas stream includes a fluid collection member comprising one or more collection electrodes. The panel may include an emitter electrode assembly member comprising an emitter electrode frame and one or more emitter electrodes attached to the emitter electrode frame (e.g., disposed in a one- or two-dimensional array). The one or more emitter electrodes may be physically separated from the one or more collection electrodes. The fluid collection member may be physically connected to the emitter electrode assembly member. The one or more collection electrodes may be electrically insulated from the one or more emitter electrodes.

Another example of a panel for use in collecting fluid in a gas stream includes a fluid collection member comprising one or more collection electrodes. The panel may include an emitter electrode assembly member comprising one or more emitter electrodes (e.g., disposed in a one- or two-dimensional array). The emitter electrode assembly member may be attached to the fluid collection member by one or more electrically insulating members. The one or more electrically insulating members may be disposed between the fluid collection member and the emitter electrode assembly member.

Another example of a panel for use in collecting fluid in a gas stream includes an emitter electrode assembly member comprising one or more tensioned wire electrodes on an emitter electrode frame (e.g., disposed in a one- or two-dimensional array). The panel may include a fluid collection member comprising an electrically conductive (e.g., metallic) collection surface. The emitter electrode assembly member may be disposed within no more than 0.5 meters (m) of the fluid collection member.

Any one or more of the aforementioned examples of a panel may include one or more of the following features, either alone or in combination.

The one or more collection electrodes may be an electrically conductive (e.g., metal) collection surface. In some embodiments, the collection surface is planar. In some embodiments, the collection surface is a mesh (e.g., a mesh of large gauge metal wires). In some embodiments, the collection surface comprises a metal mesh. In some embodiments, the collection surface is a porous metal plate. The collection surface may have a larger area than the emitter electrode assembly member. In some embodiments, the collection surface has a low contact angle hysteresis (e.g., of no more than 40 degrees difference between a receding contact angle and an advancing contact angle, for example when the panel is disposed at an angle of from 30 degrees to 60 degrees relative to level ground).

The fluid collection member may comprise a collection frame. The one or more collection electrodes (e.g., collection surface) may be attached to the collection frame. The collection frame may surround a portion of the one or more collection electrodes (e.g., collection surface) around at least a portion of an outer perimeter of the collection surface, for example on one or more edges of the outer perimeter. The collection surface may be tack-welded to the collection frame at one or more locations. In some embodiments, at least a portion (e.g., a bottom portion) of the collection frame is perforated (e.g., perforated at a linear density of 3-5 holes per 10 mm). In some embodiments, the panel comprises one or more rotatable trolley members (e.g., each comprising a ball bearing about which the member rotates) attached to the collection frame. In some embodiments, the collection frame comprises an edge (e.g., a J-edge) (e.g., a metal edge) (e.g., wherein the edge comprises a perforated portion wrapped around the portion of the collection surface). The collection frame may comprise one or more edges (e.g., J-edge) disposed around an entire outer perimeter of the collection surface.

Each of the one or more emitter electrodes may be a metal wire. A diameter of the metal wire may be from 50 micrometers (μm) to 10 millimeters (mm) (e.g., from 50 μm to 250 μm or from 100 μm to 200 μm). A tensile strength of the wire may be at least 1 GPa. In some embodiments, the one or more emitter electrodes are attached to the emitter electrode frame under tension. In some embodiments, the one or more emitter electrodes are each entirely under at least 4 N and not more than 20 N of tension (e.g., at least 6 N and not more than 8 N of tension).

The one or more emitter electrodes may be attached to an emitter electrode frame using one or more springs. In some embodiments, each of the one or more springs is a constant force spring. In some embodiments, each of the one or more emitter electrodes is attached to the emitter electrode frame at a first end by a corresponding spring. In some embodiments, a second end of each of the one or more emitter electrodes is fixed by a wire connector stud. In some embodiments, each of the one or more emitter electrodes is wound around at least three electrically insulating capstans (e.g., polytetrafluoroethylene (PTFE) or nylon capstans). In some embodiments, at least two of the at least three capstans are on opposite ends of the emitter electrode frame.

In some embodiments, each of the one or more emitter electrodes comprises hardened steel. In some embodiments, each of the one or more emitter electrodes comprises SAE 304 stainless steel (e.g., hardened SAE 304 stainless steel). In some embodiments, one or more emitter electrodes comprise (e.g., each comprise) a metal selected from the group consisting of titanium, tungsten, and copper.

In some embodiments, the emitter electrode frame is electrically insulating. In some embodiments, the emitter electrode frame comprises fiberglass reinforced plastic.

In some embodiments, the fluid collection member and the emitter electrode assembly member are physically connected using one or more electrically insulating members (e.g., at least four or at least six electrically insulating members). The one or more electrically insulating members may have a dielectric strength of at least 200 kV/cm (e.g., at least 400 kV/cm). The one or more electrically insulating members may have a surface energy of no more than 25 mN/m. Each of the one or more electrically insulating members may comprise polytetrafluoroethylene (PTFE). Each of the one or more electrically insulating members may comprise one or more sheds. Each of the one or more electrically insulating members may comprise three sheds. In some embodiments, the one or more sheds overhang a central core of the electrically insulating member by a distance from 10 mm to 20 mm. In some embodiments, each of the one or more sheds is separated from each adjacent shed by a distance of from 10 mm to 30 mm. The distance may be from 17.5 mm to 22.5 mm. Each of the one or more sheds may have a thickness of from 2 mm to 3 mm. In some embodiments, each of the one or more sheds comprises a knife edge (e.g., an about 60° knife edge). Each of the one or more electrically insulating members may be cylindrical. In some embodiments, each of the one or more electrically insulating members has a longitudinal length and the longitudinal length may be from 25 mm to 150 mm, for example from 25 mm to 75 mm.

In some embodiments, a panel comprises a second emitter electrode assembly member. The second emitter electrode assembly member may comprise a second emitter electrode frame and one or more second emitting electrodes attached to the second emitter electrode frame (e.g., disposed in a one- or two-dimensional array). The second emitter electrode assembly member is physically attached to and electrically insulated from the fluid collection member. The second emitter electrode assembly member may be disposed on an opposite side of the fluid collection member from the emitter electrode assembly member. The fluid collection member may be disposed at least partially between the second emitter electrode assembly member and the emitter electrode assembly member.

Each of the one or more emitter electrodes may be a needle (e.g., having a small radius of curvature) (e.g., disposed in a one- or two-dimensional array) (e.g., disposed perpendicular to the collection surface). Each of the one or more emitter electrodes may comprise one or more small radius of curvature points (e.g., one or more needles, or pipes or rods with one or more spikes, or a combination thereof) (e.g., disposed in a one- or two-dimensional array) (e.g., disposed perpendicular to the collection surface) (e.g., disposed parallel to the collection surface).

In some embodiments, the panel is operable to maintain a voltage of at least 1 kV, and optionally no more than 500 kV, at the one or more emitter electrodes (and/or, separately, the one or more second emitter electrodes). The voltage may be at least 25 kV, at least 50 kV, or at least 100 kV, and optionally no more than 250 kV.

In some embodiments, the fluid collection member and the emitter electrode assembly member are separated by no more than 0.5 m (e.g., no more than 0.4 m, no more than 0.3 m, or no more than 0.2 m). In some embodiments, the fluid collection member and the emitter electrode assembly member are separated by a distance from 0.005 m to 0.1 m (e.g., 0.025 m to 0.1 m).

The panel may be rectangular. The panel may be triangular. The panel may have an area between 1.25 $m^2$ and 3.25 $m^2$. The one or more collection electrodes (e.g., the collection surface) may be grounded. The panel may be modular.

BRIEF DESCRIPTION OF THE DRAWINGS

Drawings are presented herein for illustration purposes, not for limitation. The foregoing and other objects, aspects, features, and advantages of the disclosure will become more apparent and may be better understood by referring to the following description taken in conjunction with the accompanying drawings, in which.

DETAILED DESCRIPTION OF CERTAIN EMBODIMENTS

Figure 1A:
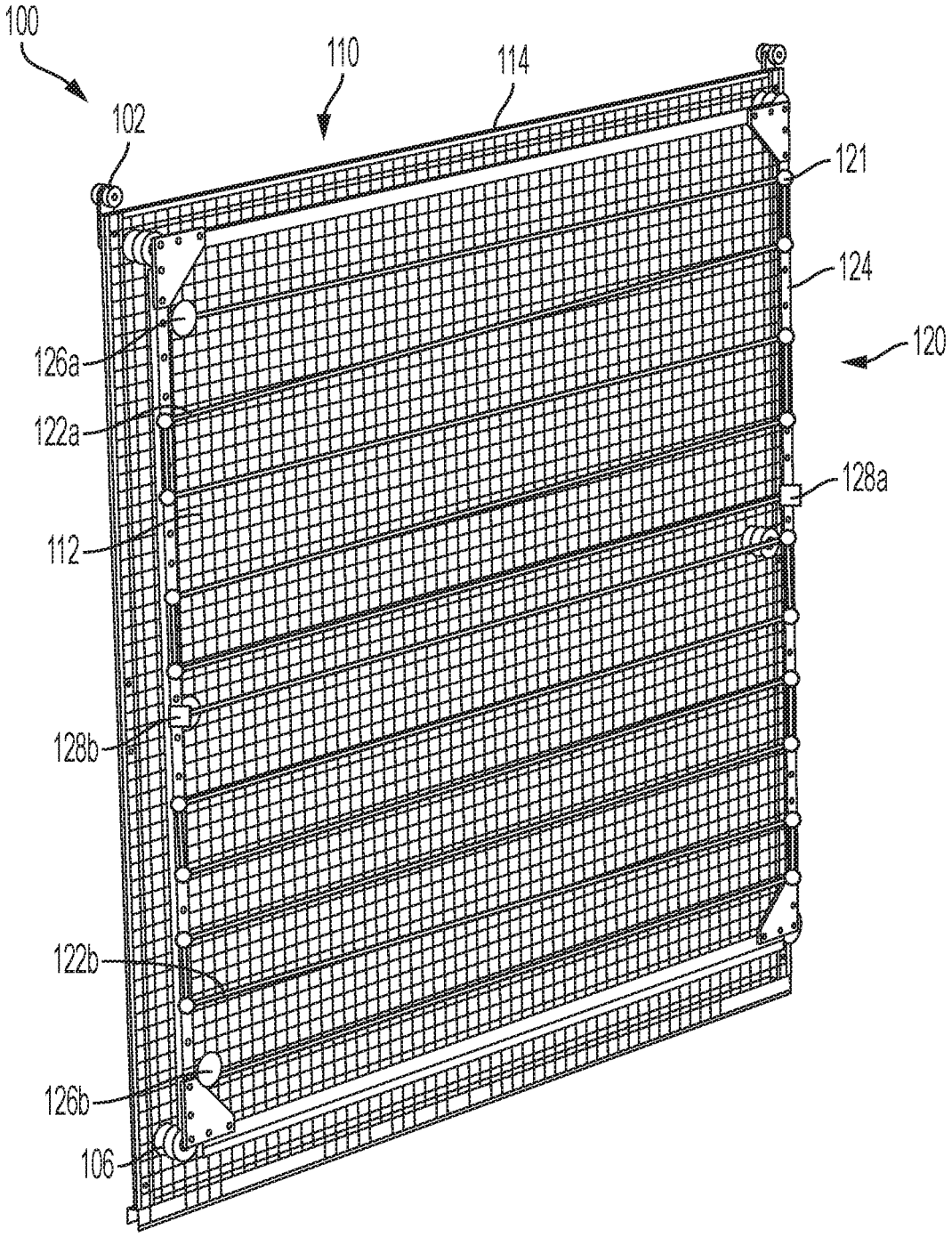
FIGS. 1A and 1B are two views of a panel, according to illustrative embodiments of the disclosure.

It is contemplated that systems, apparatus, and methods of the disclosure encompass variations and adaptations developed using information from the embodiments expressly described herein. Adaptation and/or modification of the systems, apparatus, and methods described herein may be performed by those of ordinary skill in the relevant art.

Throughout the description, where apparatus and systems are described as having, including, or comprising specific components, or where processes and methods are described as having, including, or comprising specific steps, it is contemplated that, additionally, there are articles, devices, and systems according to certain embodiments of the present disclosure that consist essentially of, or consist of, the recited components, and that there are methods according to certain embodiments of the present disclosure that consist essentially of, or consist of, the recited processing steps.

It should be understood that the order of steps or order for performing certain action is immaterial so long as operability is not lost. Moreover, two or more steps or actions may be conducted simultaneously.

In this application, unless otherwise clear from context or otherwise explicitly stated, (i) the term "a" may be understood to mean "at least one"; (ii) the term "or" may be understood to mean "and/or"; (iii) the terms "comprising" and "including" may be understood to encompass itemized components or steps whether presented by themselves or together with one or more additional components or steps; (iv) the terms "about" and "approximately" may be understood to permit standard variation as would be understood by those of ordinary skill in the relevant art; and (v) where ranges are provided, endpoints are included. In certain embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

The present disclosure describes a panel for use in collecting fluid in a gas stream. In some embodiments, the panel include a fluid collection member with one or more collection electrode (e.g., an electrically conductive collection surface) and an emitter electrode assembly member comprising an emitter electrode frame and one or more emitter electrodes attached to the emitter electrode frame.

Disclosed herein are, inter alia, panels for use in collecting fluid from a gas stream. A panel may include one or more emitter electrodes and one or more collection electrodes. The emitter electrode(s) are operable to maintain an applied voltage to cause fluid to be deposited on collection electrode(s) at a higher rate than would be deposited on the collection electrode(s) without the applied voltage. One or more emitter electrodes may be, for example, one or more wires, and one or more collection electrodes may be, for example, a metallic mesh collection surface. A panel may provide a convenient component that can be easily handled and installed in a fluid collection system. In some embodiments, a panel is modular and thus can be interchanged in a fluid collection system, for example if a panel malfunctions or breaks. For example, one or more emitter electrode wires may break as a result of prolonged applied voltage. A broken panel can be removed from a fluid collection system and replaced with a functional panel. The broken panel may be repairable, thereby reducing waste.

Figure 1B:
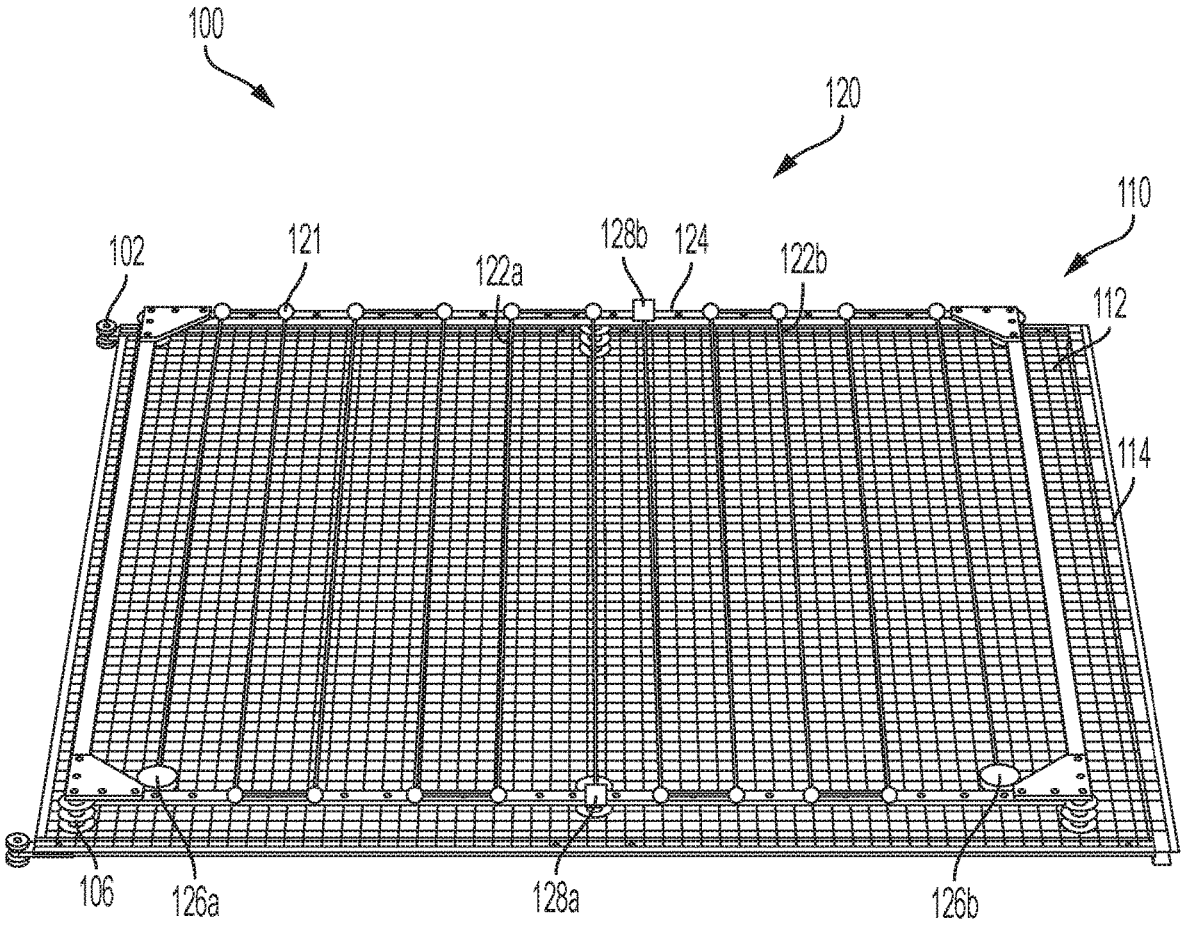

Referring now to FIGS. 1A-1F, an example of a panel 100 for use in collecting fluid from a gas stream is shown. As shown in FIGS. 1A and 1B, panel 100 includes emitter electrode assembly member 120 and fluid collection member 110. Emitter electrode assembly member 120 includes metal wires 122*a-b* (which are emitter electrodes), emitter electrode frame 124, capstans 121, springs 126*a-b*, and wire connector studs 128*a-b*. Fluid collection member 110 includes electrically conductive mesh collection surface 112 (which is a collection electrode) attached to collection frame 114. Emitter electrode assembly member 120 is physically attached to and electrically insulating from fluid collection member 110, in this example using electrically insulating members 106. In this example, six electrically insulating members 106 are used. Electrically insulating members 106 are specifically attached to emitter electrode frame 124 and collection frame 114, but other connection locations may be used. Electrically conductive mesh collection surface 112 is physically separated from metal wires 122*a-b*, in this example by virtue of electrically insulating members 106. Collection surface 112 has a larger area than emitter electrode assembly member 120. Emitter electrode assembly member 120 is disposed within no more than 0.5 m of fluid collection member 110. Electrically conductive mesh collection surface 112 may be grounded, for example when panel 100 is installed in a fluid collection system.

One or more emitter electrodes may include one or more wires. Wires used as emitter electrodes may be metallic. For example, a wire may include one or more of stainless steel, copper, aluminum, silver, gold, titanium, and tungsten. In some embodiments, a wire has a diameter from 50 μm to 10 mm. For example, a wire may have a diameter from 50 μm to 250 μm or from 100 μm to 200 μm. In some embodiments, a wire comprises 304 stainless steel. For example, a wire may be made from spring back (hardened) 304 stainless steel. In some embodiments, a wire has a tensile strength of at least 1 GPa. Without wishing to be bound by any particular theory, a wire with higher tensile strength may partially or completely mitigate wire-snapping failures from any source of wire deflection or wire vibration during operation of a panel. One or more emitter electrodes may be attached to an emitter electrode frame (for example as shown in FIGS. 1A-1B) under tension. One or more emitter electrodes may be wrapped around an emitter electrode frame, for example using one or more capstans (e.g., as discussed in subsequent paragraphs). In some embodiments, an emitter electrode is a needle (e.g., having a small radius of curvature). A panel may comprise an emitter electrode assembly member comprising a one- or two-dimensional array of needles (e.g., disposed perpendicular to the collection surface). In some embodiments, an emitter electrode is a small radius of curvature point, such as a needle or pipe or rod with spikes. A small radius of curvature may be sufficient to generate electrical discharge (e.g., corona discharge). For example, an emitter electrode may be similar or identical to an emitter electrode used in an electrostatic precipitator, some of which use various types of small radius of curvature points to generate corona discharge. Emitter electrodes, such as needles, may be disposed, for example, perpendicular to or parallel to a collection surface or have a combination of orientations relative to the collection surface. In some embodiments, a panel is operable to maintain a voltage of at least 1 kV, and optionally no more than 500 kV, at one or more emitter electrodes. For example, a panel may be operable to maintain a voltage of at least 25 kV, at least 50 kV, or at least 100 kV (e.g., and no more than 250 kV) at one or more emitter electrodes.

One or more collection electrodes may include an electrically conductive collection surface. A collection surface may be, for example, an electrically conductive mesh or porous surface. A collection surface may comprise metal, such as stainless steel for example. A mesh may be made of large gauge metal wires for example. As another example, a collection surface may be a porous metal plate. A collection surface may be planar. One or more collection electrodes may be disposed in a planar arrangement. In some embodiments, a collection surface has a low contact angle hysteresis (e.g., of no more than 40 degrees difference between a receding contact angle and an advancing contact angle, e.g., when a panel is disposed at an angle of from 30 degrees to 60 degrees relative to level ground). Low contact angle hysteresis may help in shedding water during fluid collection.

Figure 3A:
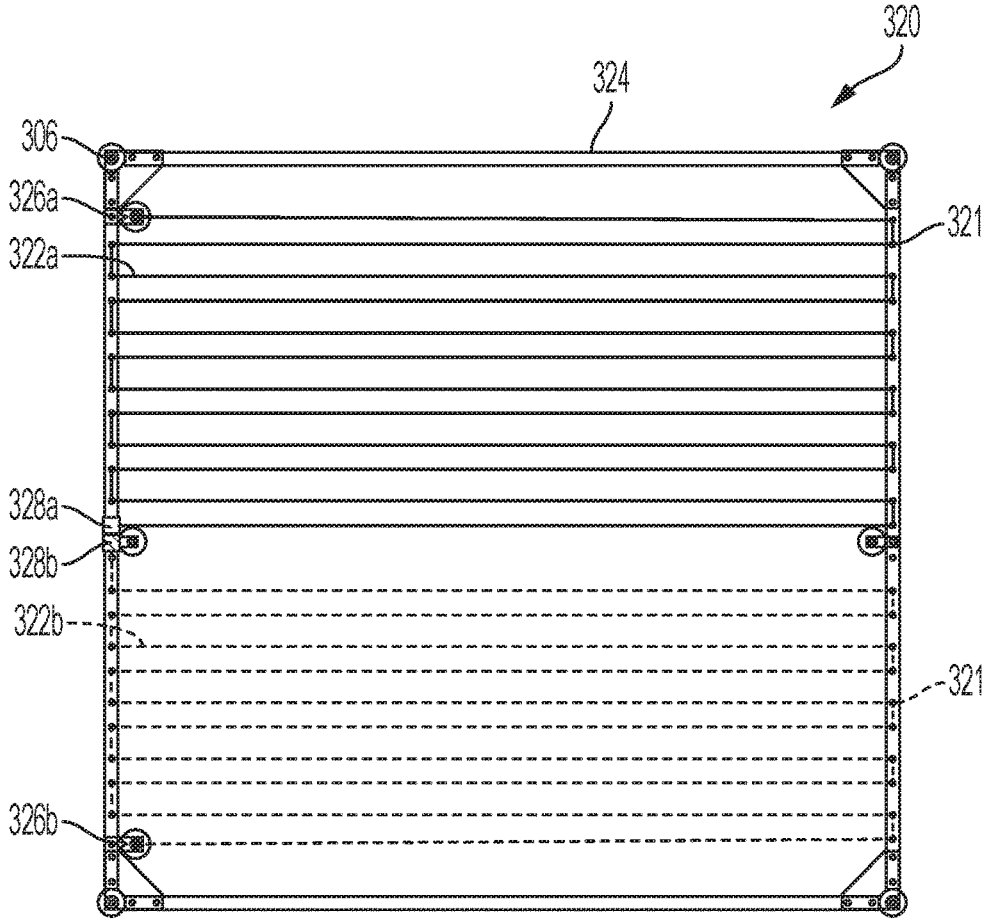
FIG. 3A is a plan view of an emitter electrode assembly member, according to illustrative embodiments of the disclosure.

Referring again to FIGS. 1A-1F and as shown in FIGS. 1A, 1B, and 1E, wires 122*a-b* are wrapped around emitter electrode frame 124 using capstans 121 and held on one end by wire connector studs 128*a-b* and on the other end by springs 126*a-b*. Emitter electrode frame 124 is electrically insulating. For example, emitter electrode frame may be made from fiberglass reinforced plastic (thereby having a relatively high rigidity while also being electrically insulating). An electrically insulating emitter electrode frame may avoid or reduce additional discharge and ion generation from the emitter electrode frame during operation. Wires 122*a-b* are under tension along their lengths. For example, wires 122*a-b* may be entirely under at least 4 N and not more than 20 N of tension, for example along their entire length. In some embodiments, emitter electrode(s) are each entirely under at least 6 N and not more than 8 N of tension. Springs 126*a-b* are constant force springs. Constant force springs may be used to produce more uniform tension and emitter electrode(s) may therefore have more uniform properties (e.g., electrical properties) across the area of a panel. Wires 122*a-b* are wound around (e.g., less than one full rotation around) capstans 121, which are spaced apart on emitter electrode frame 124, in order to space them across a fluid collection area. Capstans 121 are low friction, thereby negligibly influencing impacting the tension of wires 122*a-b* as they are wrapped. FIG. 1E shows a close up of one of wires 122 wrapped around one of capstans 121, which is attached to emitter electrode frame 124. In some embodiments, each emitter electrode is wound around at least three capstans. An additional example of wire emitter electrodes disposed on an emitter electrode frame is shown in FIG. 3A and discussed in subsequent paragraphs.

Figure 1C:
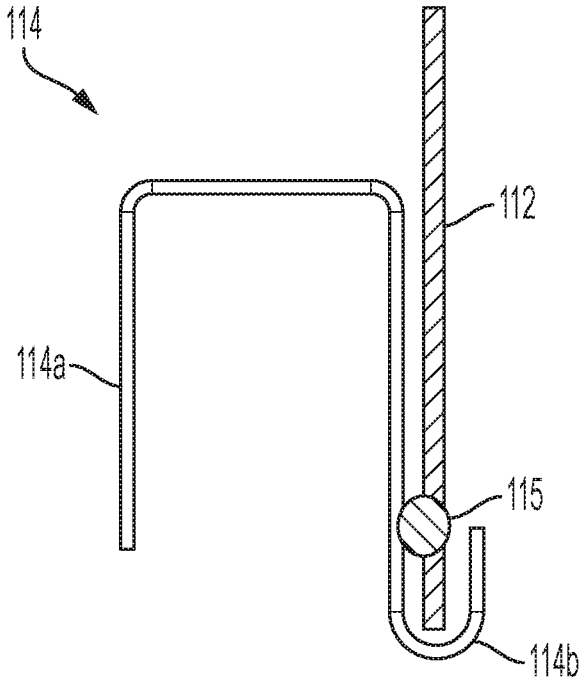
FIG. 1C is a cross section of an edge of a collection frame, according to illustrative embodiments of the disclosure.
Figure 1D:
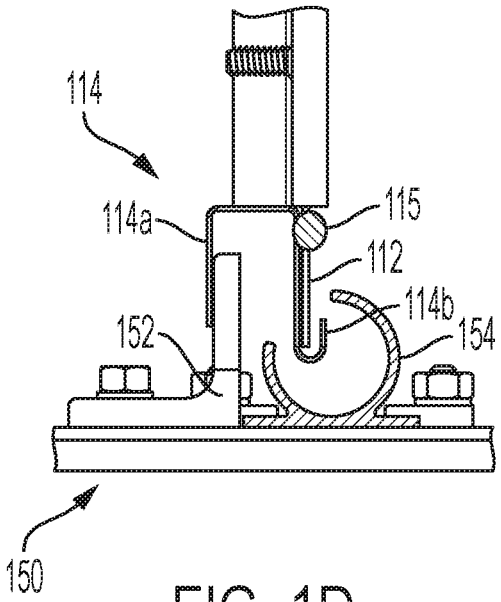
FIG. 1D is a view of a bottom portion of a panel that is mounted to a frame that includes a gutter, according to illustrative embodiments of the disclosure.
Figure 1E:
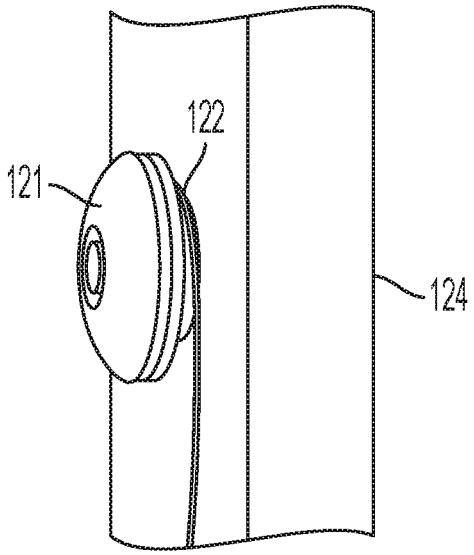
FIG. 1E is a view of a wire emitter electrode wound around a capstan that is attached to an emitter electrode frame, according to illustrative embodiments of the disclosure.

FIG. 1C shows an edge that is used in collection frame 114. In this example, the edge is a J-edge. The J-edge includes a curved portion 114*b*. Curved portion 114*b* surround (e.g., covers and protects) a portion of mesh collection surface 112 around at least a portion of an outer perimeter of collection surface 112. Such an arrangement may be preferred when collection electrode(s) such as a mesh collection surface made of thick gauge metal wire are used as it can improve handling of a fluid collection member and/or a panel. Mesh collection surface 112 is attached to collection frame 114 at curved portion 114*b* using tack welds 115. J-edge of collection frame 114 includes optional vertical portion 114*a* that may be used mount panel 100 to a frame (as shown in FIG. 1D and discussed in a subsequent paragraph). Collection frame 114 may include a J-edge that is one continuous piece of J-edge that is shaped into the frame, for example, or it may include multiple pieces of J-edging that may be fastened together. For example, collection frame 114 may have a corresponding piece of J-edging for each edge of collection surface 112, the corresponding pieces of J-edging being fastened together.

At least a portion of collection frame 114 (e.g., J-edging thereof) may be perforated. For example, an edge of collection frame 114 may be perforated or a portion of an edge may be perforated. For example, curved portion 114*b* of J-edge may be perforated and/or a bottom J-edge of collection frame 114 may be perforated (and, optionally other edges not). Perforated J-edging of collection frame 114 may be made from perforated sheet metal such as SAE 304 stainless steel perforated with holes at a linear density of from 3 to 5 holes per 10 mm, for example. Perforated edging may assist in efficient and/or directionally desirable fluid drainage away from panel 100 (e.g., into gutter 154 as shown in FIG. 1D and discussed in a subsequent paragraph). In some embodiments, collection surface 112 is a porous plate instead of a mesh.

Edging around one or more collection electrodes (e.g., a collection surface) may serve one or more of multiple purposes. An edge may enable facile handling of a panel so that it can be manipulated into and out of a fluid collection system. An edge may give rigidity to a panel by giving it a stiff border. In some embodiments, this reduces or eliminates the likelihood that a mesh collection surface will buckle under its own weight and is fixed (does not change size) at its overall dimension (e.g., 1.5 m×1.5 m). A curved portion of an edge (e.g., a J-edge) may allow for easy access to a mesh-wire to edging interface, which allows for periodic spot welding (tack welds) along the length of a fluid collection member. Welding together a mesh collection surface and collection frame at an edge thereof may ensure the mesh and J-edge behave as a single piece and/or may remove the ability for the mesh collection surface to rattle around inside of the edge. In some embodiments, for example along a bottom edge (e.g., J-edge), edge sheet metal may be perforated to allow for collected fluid to easily drain into guttering of a fluid collection system. A perforated edge may include metal that is perforated with a linear density of from 3 to 5 holes per 10 mm, for example in SAE 304 stainless steel sheet metal. Such perforation can allow for sufficient drainage for expected collection rates while also maintaining desired overall rigidity of a panel for facile handling and placement into a fluid collection system. A vertical portion of an edge (e.g., portion 114*a* of edging in collection frame 114) enables a surface to clamp a panel in place inside of a fluid collection system.

FIG. 1D is a view of a bottom portion of panel 100 when it is installed in frame 150. Collection frame 114 is attached to frame 150 at connection point 152. For example, collection frame 114 may be fastened to connection point 152 using, for example, a clamp. Clamping the panels may allow for maintaining the proper spacing between adjacent panels, and avoid fatigue failures due to unnecessary vibrations of the panels. Collection surface 112 is tacked welded to a bottom portion of collection frame 114 that includes a J-edge. A curved portion 114*b* of the J-edge partially surrounds. The bottom portion of is made from perforated sheet metal to assist fluid collected at collection surface 112 in efficiently draining down into gutter 154 of frame 150. Gutter 154 may be made from extruded plastic, such as ultra-high molecular weight polyethylene. In some embodiments, gutter 154 is used to drain collected fluid from each panel to different parts of a fluid collection system.

Figure 1F:
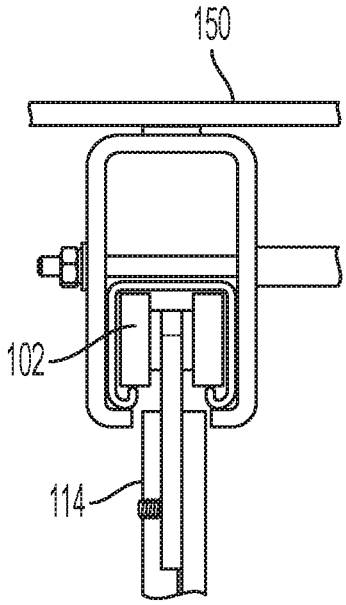
FIG. 1F is a view of a rotatable trolley member of a panel installed in a track of a frame, according to illustrative embodiments of the disclosure.

FIG. 1F shows a close up of rotatable trolley member 102 as installed in a track of frame 150. Rotatable trolley member 102 is attached to collection frame 114. In some embodiments, the top part of a panel is connected to a trolley system. In some embodiments, the trolley system is a UNISTRUT® trolley system that entails a metallic hanger that holds a U-channel. A panel may be affixed with a standard ball-bearing rotatable trolley member that is sized to fit inside the U-channel and allow for sliding the panel back and forth along the length of the channel. Such a setup can be used to facilitate installation and interchanging of modular panels from a frame of a fluid collection system.

Figure 2A:
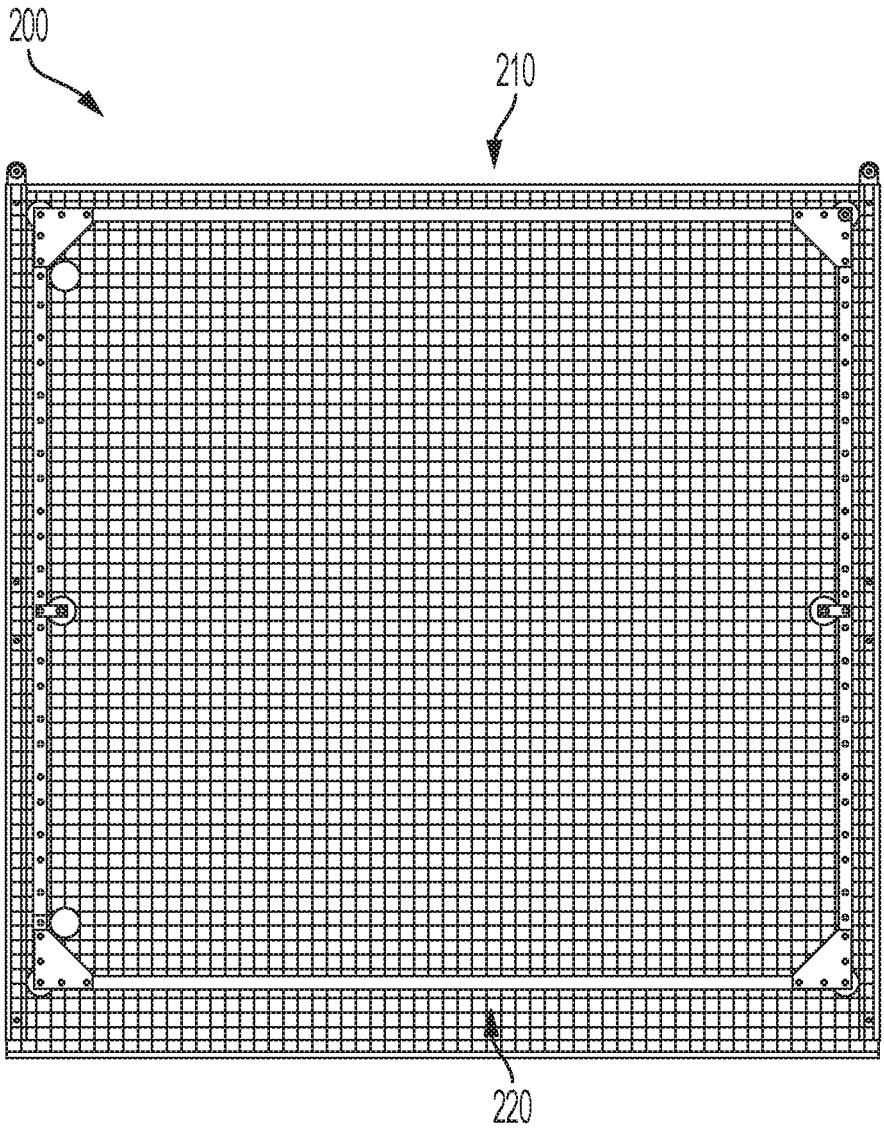
FIGS. 2A and 2B are a plan view and a cross section, respectively, of a panel according to illustrative embodiments of the disclosure.
Figure 2B:
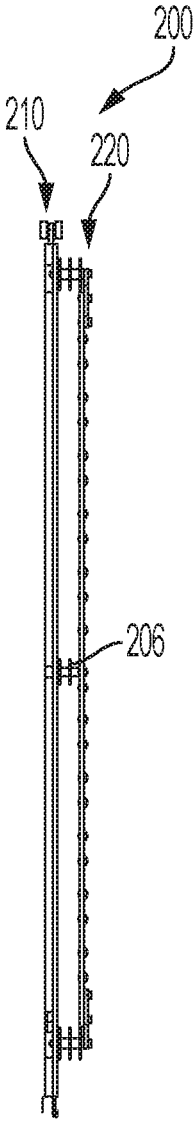

FIGS. 2A and 2B show a plane and side view, respectively, of an example of a panel 200. Panel 200 includes fluid collection member 210 and emitter electrode assembly member 220. Fluid collection member 210 is physically attached to and electrically insulated from emitter electrode assembly member 220 using electrically insulating members 206. Mesh collection surface of fluid collection member 210 is physically separated from emitter electrode(s) of emitter electrode assembly member 220. Panel 200 is rectangular and flat. Fluid collection member 210 is larger than emitter electrode assembly member 220. As shown, mesh collection surface of fluid collection member 210 has a larger extent than emitter electrode(s) of emitter electrode assembly member 220.

In some embodiments, a panel is flat (e.g., planar). A panel may be rectangular or triangular, for example. A panel may be round (e.g., circular). In some embodiments, an emitter electrode assembly member is disposed within no more than 0.5 m of a fluid collection member. In some embodiments, a fluid collection member and an emitter electrode assembly member are separated by no more than 0.5 m (e.g., no more than 0.4 m, no more than 0.3 m, or no more than 0.2 m). In some embodiments, a fluid collection member and an emitter electrode assembly member are separated by a distance from 0.005 m to 0.1 m (e.g., 0.025 m to 0.1 m). In some embodiments, a panel has an area between 1.25 $m^2$ and 3.25 $m^2$. Panels may also be smaller or larger. Panel size may depend on particular application.

FIG. 3A is a schematic of an example of a emitter electrode assembly member 320. Emitter electrode assembly member 320 includes emitter electrode frame 324, emitter electrodes 322*a-b* (which are metal wires), constant force springs 326*a-b*, capstans 321, and wire connector studs 328*a-b*. Electrically insulating members 306 are attached to emitter electrode frame 324. One end of emitter electrode 322*a* is fixed (in this example to electrode frame 324) at wire connector stud 328*a*. Emitter electrode 322*a* is wound around a plurality of capstans 321 and the other end is attached to constant force spring 326*a*, which is itself attached to electrode frame 324. One end of emitter electrode 322*b* is fixed (in this example to electrode frame 324) at wire connector stud 328*b*. Emitter electrode 322*b* is wound around a plurality of capstans 321 and the other end is attached to constant force spring 326*b*, which is itself attached to electrode frame 324. By using constant force springs 326*a-b*, emitter electrodes 322*a-b* are kept at constant tension. Capstans 321 are plastic (e.g., PTFE) cylinders with low friction. Capstans 321 are disposed up and down opposite sides of emitter electrode frame 324.

Figure 3B:
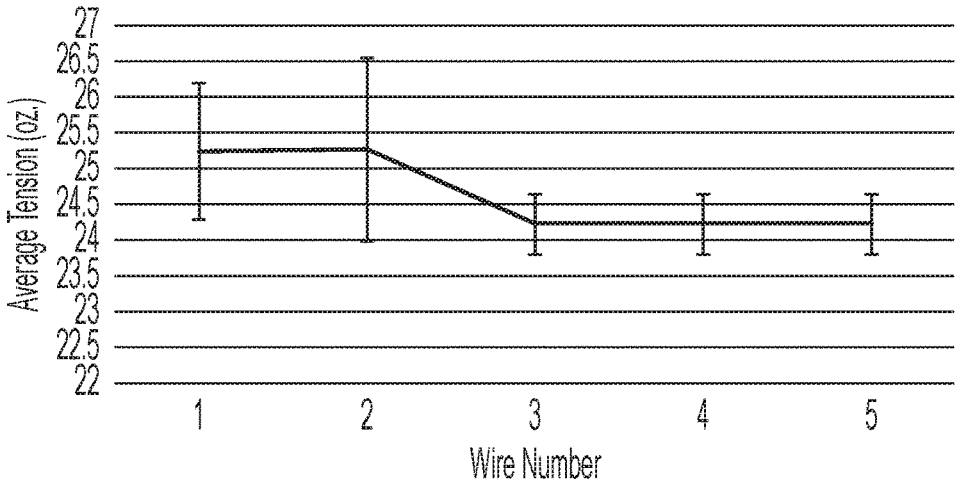
FIG. 3B is a graph of average tension for wires wrapped around capstans, according to illustrative embodiments of the disclosure.
Figure 4:
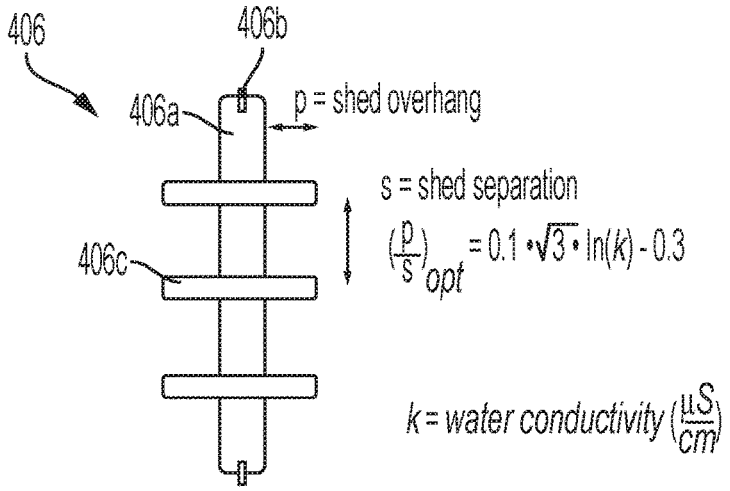
FIG. 4 is a cross section of an electrically insulating member, according to illustrative embodiments of the disclosure.

In some embodiments, it is preferable to use wires as emitter electrodes and, particularly in some embodiments, wires that are kept at a constant tension. Deformations of wires may thus be low under regular loads (e.g., ambient wind or vibration from a cooling tower). Moreover, risk of breaking may be low due to elasticity of the wire. In some applications, upon impact with a rain droplet or other object, a wire can deform and come back to its original tension (e.g., in part due to constant force springs, if present). By using capstans (e.g., small plastic cylinders, for example with a low friction coefficient), a wire can wind (partially) around them, thereby achieving a desirable spacing, and only have a minor effect on tension. A preferred number of capstans per wire can be determined so that the tension in all parts of the wire is within an acceptable range. FIG. 3B is a graph showing experimental results for wire tension. As can be seen from FIG. 3B, average wire tension stabilizes after the wire has been wound around only a small number of capstans, in this case on a ~1.5 m panel. (Wire number refers to the number of passes from side to side of the panel, for example as shown in FIG. 3A, so that a wire number of 2 corresponds to a wire that is roughly twice as long as a wire number of 1.)

Figure 5A:
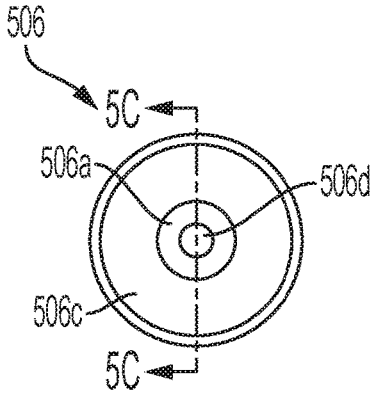
FIG. 5A is a plan view of an electrically insulating member, according to illustrative embodiments of the disclosure.
Figure 5B:
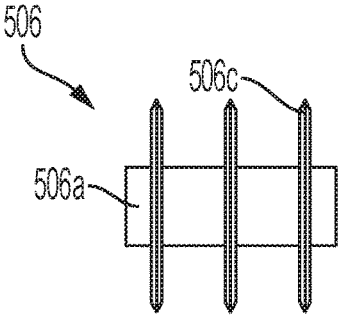
FIG. 5B is a side view of the electrically insulating member shown in FIG. 5A.
Figure 5C:
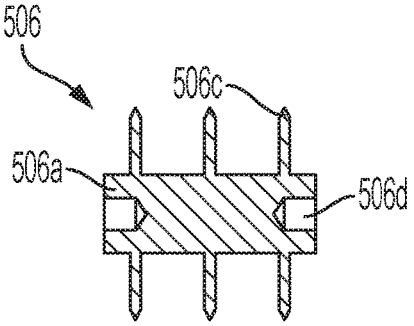
FIG. 5C is a cross section of the electrically insulating member shown in FIG. 5A taken along line A (shown in FIG. 5A)
Figure 5D:
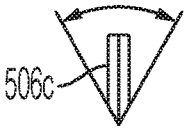
FIG. 5D is a close up of a knife edge portion of a shed of the electrically insulating member shown in FIG. 5A.
Figure 5E:
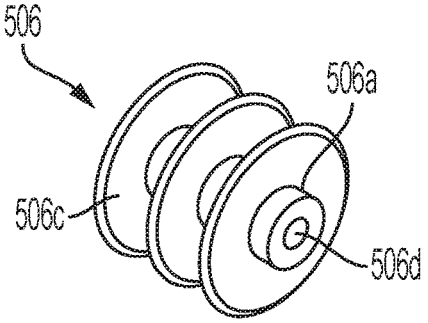
FIG. 5E is a perspective view of the electrically insulating member shown in FIG. 5A.

A panel may include one or more electrically insulating members. FIGS. 4 and 5A-5E are schematics of electrically insulating member 400 and electrically insulating member 500, respectively. Electrically insulating members 400, 500 are designed to withstand operating voltages under wet-conditions, for example in presence of fog for extended periods of time, or constant rainfall. Electrically insulating member 400 includes central core 406*a* and sheds 406*c*. Electrically insulating member 400 can be physically connected to a emitter electrode assembly member and/or a fluid collection member using fasteners 406*b* (e.g., screws or bolts). Fasteners 406*b* may be electrically conductive, but since central core 406*a* is electrically insulating, do not provide a conductive pathway through electrically insulating member 400. Electrically insulating member 500 includes central core 506*a* and sheds 506*c*. Sheds 506*c* have a 60° knife edge, as shown in FIGS. 5B, 5C, and 5D for example. Electrically insulating member 500 includes holes 506*d* (e.g., threaded holes 506*d*) for physically connecting to a emitter electrode assembly member and/or a fluid collection member using fasteners (not shown). In some embodiment, a fluid collection member is physically connected to an emitter electrode assembly member using one or more electrically insulating members (e.g., at least four or at least six electrically insulating members).

In some embodiments, insulator material, shed geometry and overall dimensions of an electrically insulating member are selected to optimize the electrically insulating member's resistance to shorting in wet conditions. An electrically insulating member may have a dielectric strength of at least 200 kV/cm (e.g., at least 400 kV/cm). An electrically insulating member may have a surface energy of no more than 25 mN/m. In some embodiments, sheds are utilized to breakup surface conduction pathways from end-to-end of an electrically insulating member and to prevent from surface arcing or surface electrical breakdown. An electrically insulating member may include polytetrafluoroethylene (PTFE). In some embodiments, an electrically insulating member comprises a polytetrafluoroethylene (PTFE) cylinder. PTFE has useful dielectric properties (a dielectric strength about 600 kV/cm) and is hydrophobic (having a surface energy of about 20 mN/m). The hydrophobicity of PTFE facilitates effective drainage of water during a wetting event and may prevent arcing due to stagnant water patches along a surface of an electrically insulating member. An electrically insulating member may be cylindrical (e.g., having a cylindrical volumetric extent).

In some embodiments, an electrically insulating member includes one or more sheds, for example three sheds. In some embodiments, shed(s) have a particular radius relative to a central core. The difference between these two values is known as the "shed overhang" dimension of an electrically insulating member. Sheds may have the same or different overhangs in a given electrically insulating member. In some embodiments, nearby sheds are spaced apart by a certain dimension that evenly spaces the sheds along a central core setting a pitch or shed separation between adjacent sheds. A ratio of shed overhang to shed pitch may be kept above a certain optimal ratio based on empirical data that correlates the optimal ratio as a function of the conductivity of a fluid (e.g., water) the electrically conductive member is being sprayed with or exposed to. This ratio increases as the fluid draining along the electrically conductive member increases in conductivity. An overall length of an electrically conductive member may be dictated by a pre-determined (e.g., optimal) spacing between emitter electrodes and fluid collection electrodes.

In some embodiments, each of one or more sheds of an electrically insulating member comprises a knife edge (e.g., an about 60° knife edge). A knife edge may facilitate droplets draining effectively from each shed and avoid any pooling on a bottom edge of the shed.

Experimental tests were performed to test various configurations of electrically insulating members. Testing results in Table 1 demonstrate how preferred designs can improve performance of electrically insulating members. Electrically insulating members of about 50 mm longitudinal length were energized up to 25 kV across the longitudinal length of the insulator while systematically wetting the entire surface of the insulator (using a water spray). Qualitative observations of sparking, or shorting, across the exterior surface of each tested electrically insulating member were made while they were wetted. The electrically insulating members were energized for 10 minutes while being wet constantly by the spray to ensure the stability of their design. In Table 1, "some" indicates some sparking or shorting was observed during the testing period, while "none" indicates no sparking or shorting was observed during the testing period.

TABLE 1

| 2 shed, 5.1 mm length, 17.8 mm spacing | 2 shed, 5.1 mm length, 20.3 mm spacing | 3 shed, 5.1 mm length, 17.8 mm spacing | 3 shed, 5.1 mm length, 20.3 mm spacing |
|---|---|---|---|
| Some | Some | None | None |

In some embodiments, a shed of an electrically insulating member overhangs a central core of the electrically insulating member by a distance from 10 mm to 20 mm. In some embodiments, a shed of an electrically insulating member is separated from each adjacent shed by a distance of from 10 mm to 30 mm, for example the distance may be from 17.5 mm to 22.5 mm. In some embodiments, a shed of an electrically insulating member has a thickness of from 2 mm to 3 mm. In some embodiments, an electrically insulating member has a longitudinal length from 25 mm to 150 mm, for example from 25 mm to 50 mm.

Figure 6:
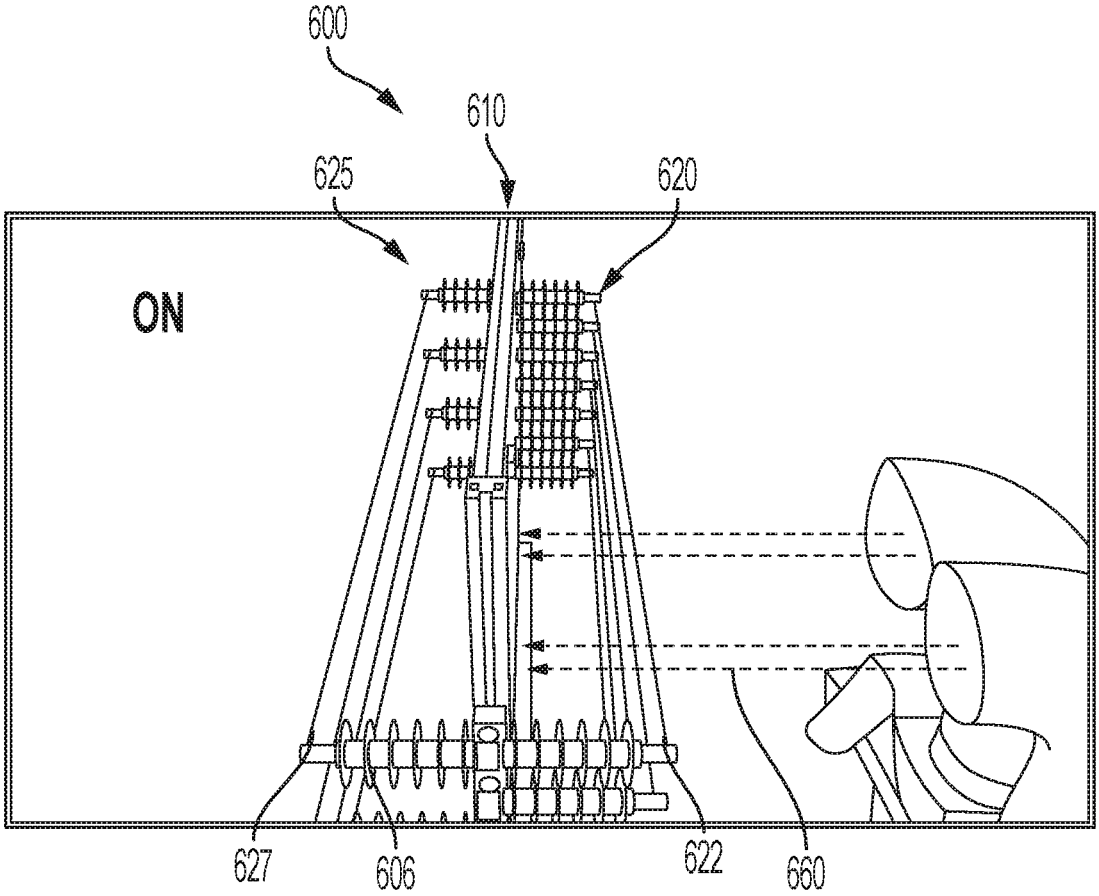
FIG. 6 is a view of a panel that includes a fluid collection member and a first emitter electrode assembly member and a second emitter electrode assembly member disposed on opposite sides of the fluid collection member, according to illustrative embodiments of the disclosure.

FIG. 6 is a view of a panel 600 in use, according to illustrative embodiments of the disclosure. Panel 600 includes fluid collection member 610, first emitter electrode assembly member 620, and second electrode assembly member 625. Fluid collection member 610 includes one or more collection electrodes (not labeled) attached to a collection frame. First and second emitter electrode assembly members 620, 625 are physically attached to and electrically insulated from fluid collection member 610 by electrically insulating members 606 (e.g., in accordance with FIG. 4 or 5A-5E described in previously). First emitter electrode assembly member 620 includes a plurality of metal wires 622 that act as emitter electrodes. The wires may be snaked back and forth several times each or may run point to point from one end of first emitter electrode assembly member 620 to another. Second emitter electrode assembly member 625 includes a plurality of metal wires 627 that act as emitter electrodes. The wires may be snaked back and forth several times each or may run point to point from one end of second emitter electrode assembly member 625 to another. Second emitter electrode assembly member 625 is disposed on an opposite side of fluid collection member 610 as first emitter electrode assembly member 620 and fluid collection member 610 is disposed at least partially between first emitter electrode assembly member 620 and second emitter electrode assembly member 625. Fluid that passes through fluid collection member 610 may be redirected towards the fluid collection member 610 by second emitter electrode assembly member 627. FIG. 6 shows complete plume 660 abatement when an appropriate voltage (e.g., in a range of from 1 kV to 500 kV) is applied to emitter electrodes 622, 627 of first and second emitter electrode assembly members 620, 625.

Figure 7A:
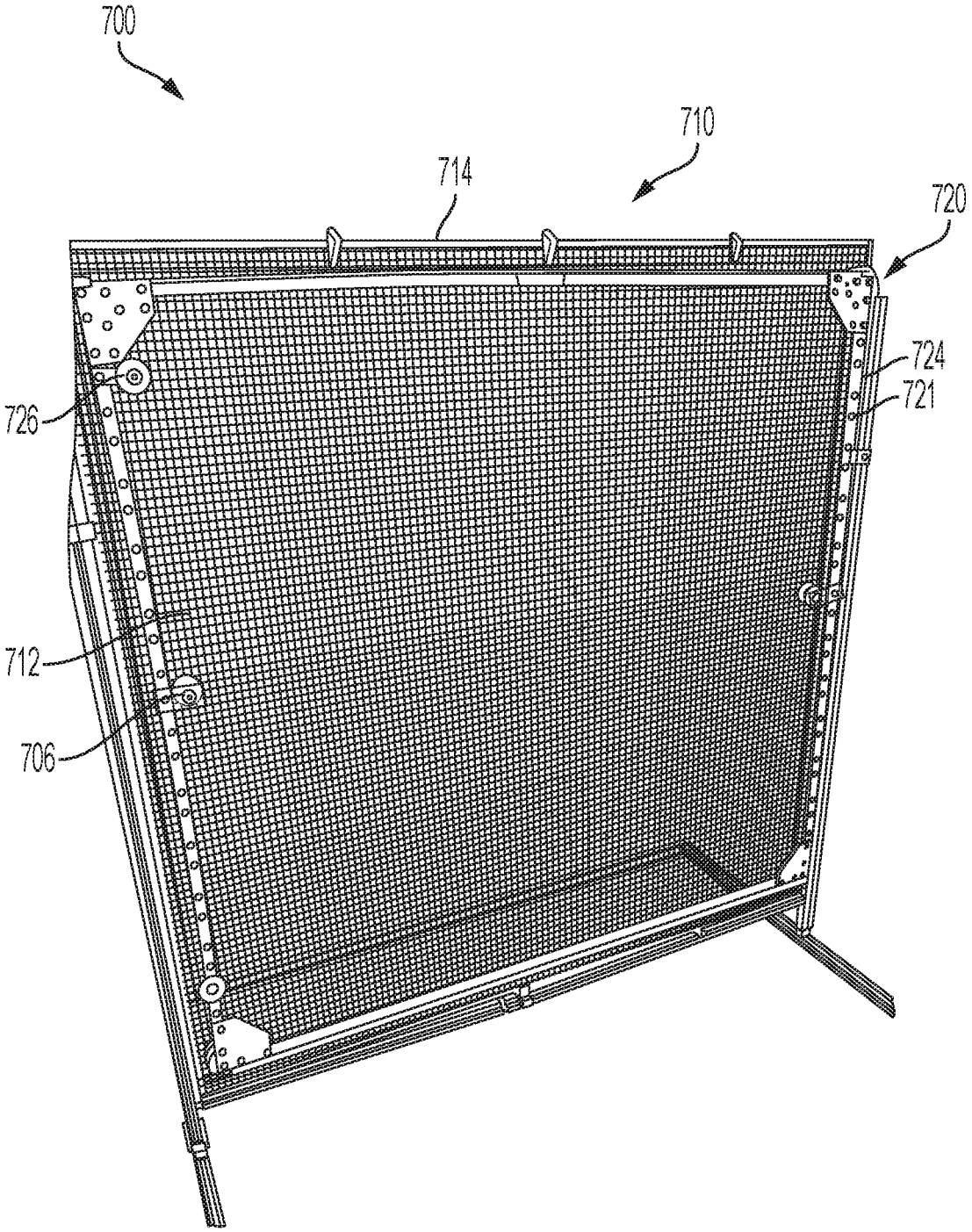
FIGS. 7A-7G are views of a constructed prototype of a panel, according to illustrative embodiments of the disclosure.
Figure 7B:
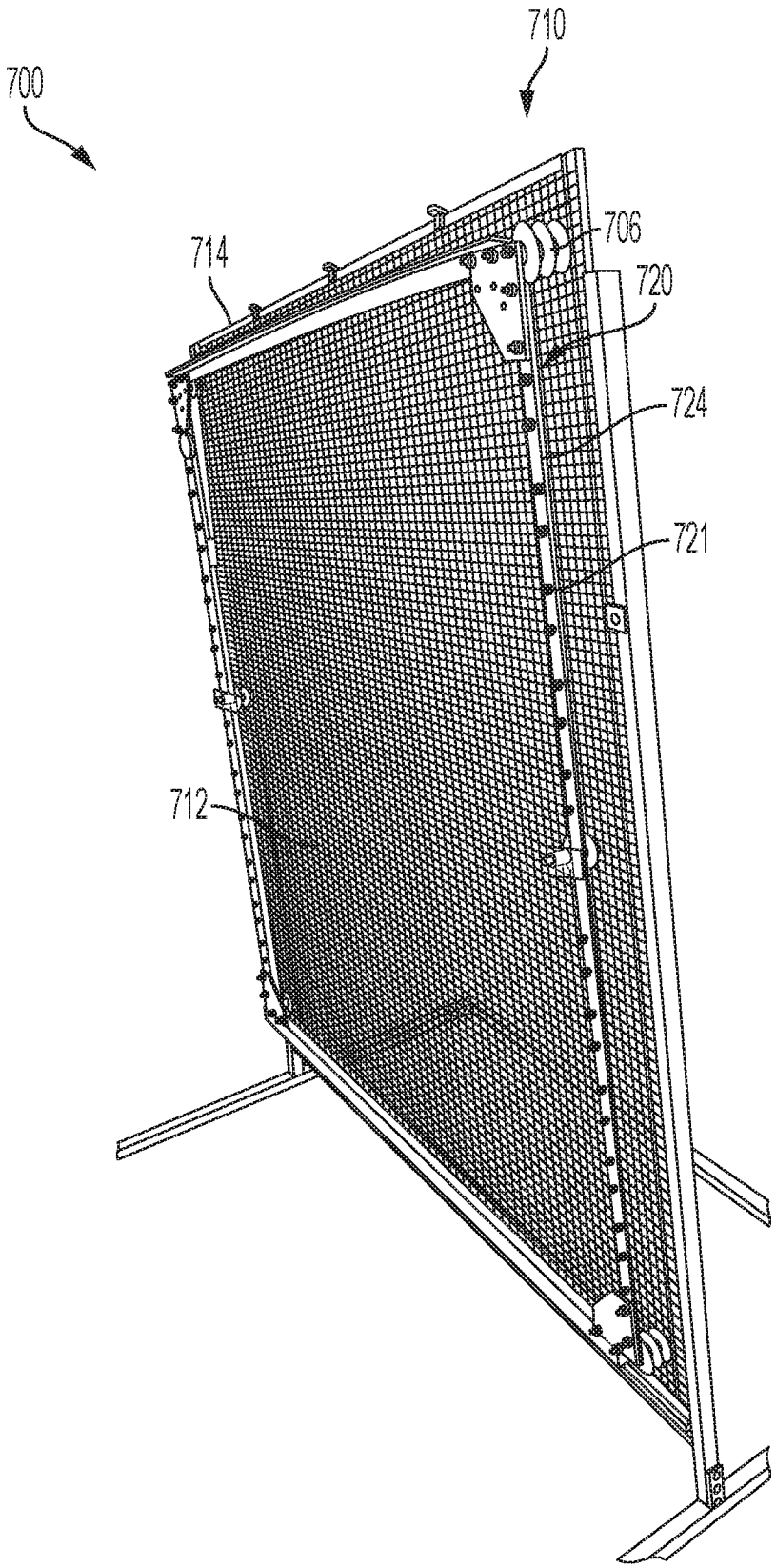
Figure 7C:
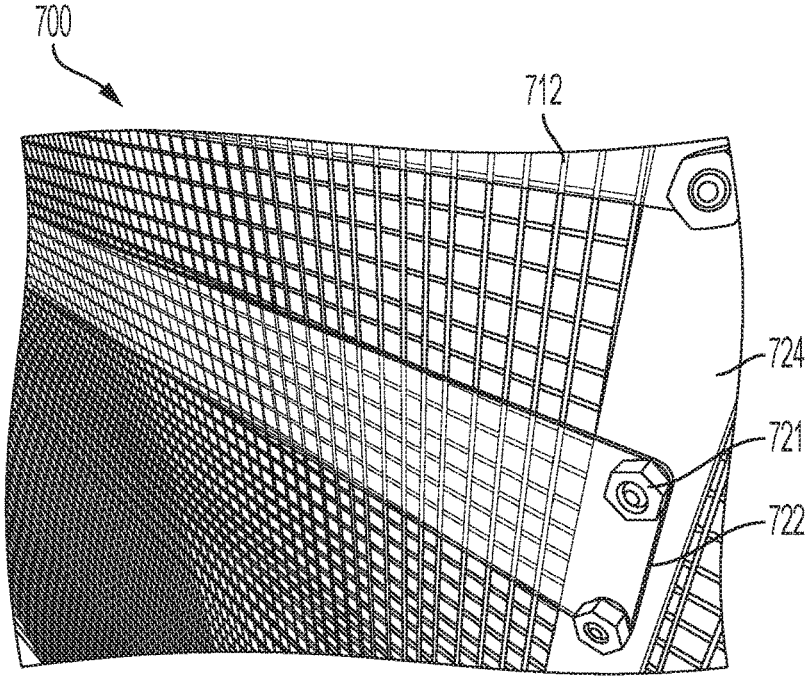
Figure 7D:
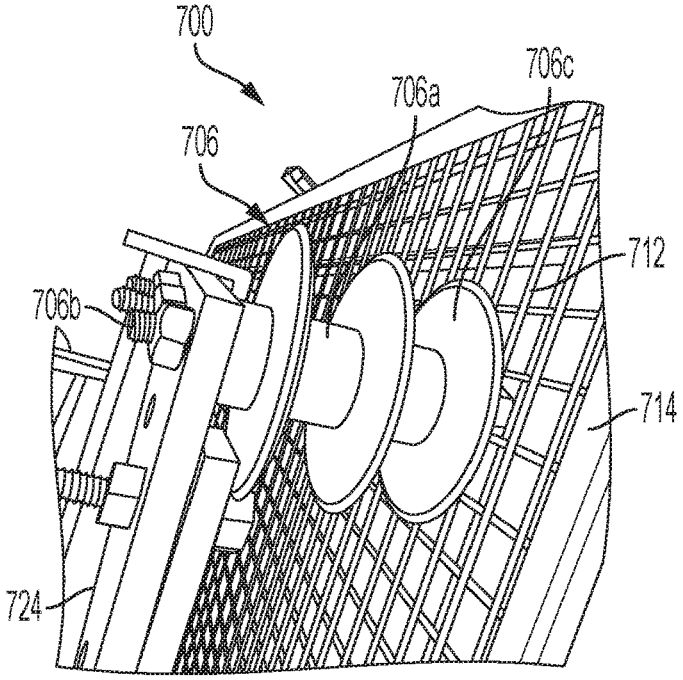
Figure 7E:
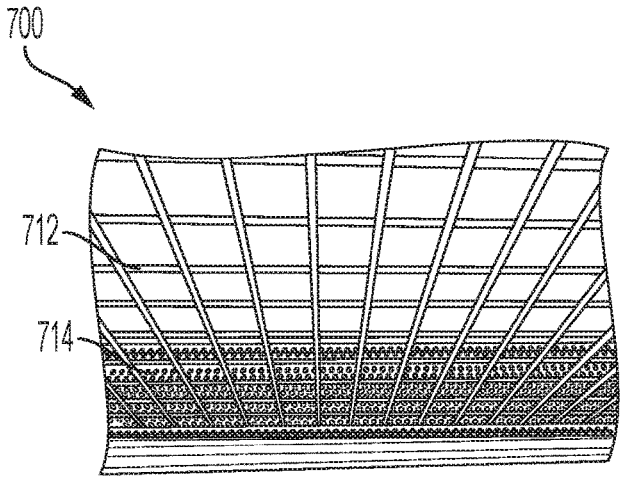
Figure 7F:
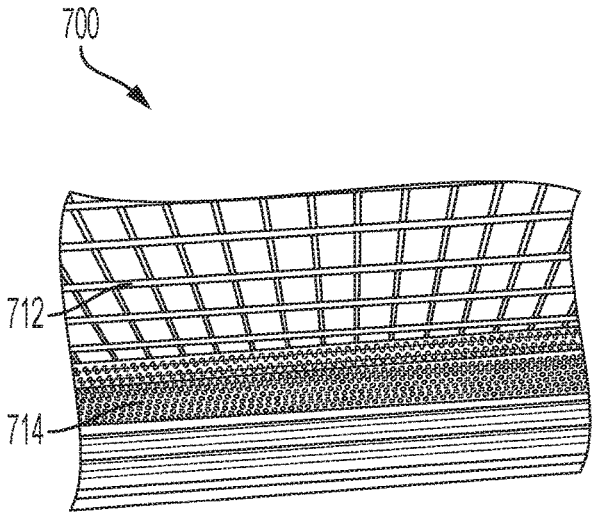
Figure 7G:
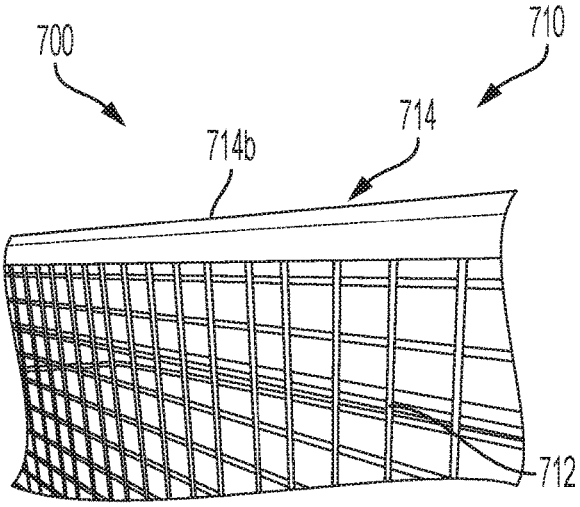

FIGS. 7A-7G show views of constructed prototype panel 700. Prototype panel 600 includes emitter electrode assembly member 720 and fluid collection member 710. Emitter electrode assembly member 720 includes emitter electrode frame 724, emitter electrodes 722 (which are metal wires), constant force springs 726, and wire connector studs (not labelled). Emitter electrode assembly member 720 also includes capstans 721, attached to emitter electrode frame 724, around which electrodes 722 are wound in order to space them, as shown in FIG. 7C. Fluid collection member 710 includes electrically conductive mesh collection surface 712 and collection frame 714. Fluid collection member 710 is physically attached to an electrically insulated from emitter electrode assembly member 720 using six electrically insulating members 706. A close up of the connection with an electrically insulating member 706 is shown in FIG. 7D. Electrically insulating member 706 may be, for example, in accordance with the electrically insulating member of FIG. 4 or FIGS. 5A-5E. As shown in FIGS. 7D-7G, an edge of collection frame 714 surrounds a portion of mesh collection surface 712 around at least a portion of an outer perimeter of collection surface 712. The edge is a J-edge (e.g., in accordance with FIG. 1C); a curved portion 714*b* of the J-edge surrounds a portion of collection surface 712 around at least a portion of an outer perimeter of collection surface 712, as shown in FIGS. 7E-7G. FIG. 7G shows a close up along a top portion of the edge of collection frame 714 and FIGS. 7E and 7F show close ups along a bottom portion of the edge of collection frame 714. Collection surface 712 is tack welded at a plurality of locations to collection frame 714 (tack welds are hidden by edge of collection frame 714). At bottom portion of collection frame 714 is formed at least partially from perforated sheet metal, as shown in FIGS. 7E-7F. A top portion of collection frame 714 is formed from non-perforated sheet metal, as shown in FIG. 7G. Emitter electrode assembly member 720 is disposed within no more than 0.5 m of fluid collection member 710.

Certain embodiments of the present disclosure were described above. It is, however, expressly noted that the present disclosure is not limited to those embodiments, but rather the intention is that additions and modifications to what was expressly described in the present disclosure are also included within the scope of the disclosure. Moreover, it is to be understood that the features of the various embodiments described in the present disclosure were not mutually exclusive and can exist in various combinations and permutations, even if such combinations or permutations were not made express, without departing from the spirit and scope of the disclosure. Having described certain implementations of panels for use in collecting fluid in a gas stream, it will now become apparent to one of skill in the art that other implementations incorporating the concepts of the disclosure may be used. Therefore, the disclosure should not be limited to certain implementations, but rather should be limited only by the spirit and scope of the following claims.

What is claimed is:

1. A panel for use in collecting fluid in a gas stream, the panel comprising:
   - a planar fluid collection member comprising one or more collection electrodes, and
   - a planar emitter electrode assembly member comprising an emitter electrode frame and one or more emitter electrodes attached to the emitter electrode frame,
   - wherein the one or more collection electrodes are physically separated from the one or more emitter electrodes by one or more electrically insulating members each comprising one or more sheds,
   - wherein the planar fluid collection member is physically connected to the planar emitter electrode assembly member and the one or more collection electrodes are electrically insulated from the one or more emitter electrodes, and
   - wherein the one or more sheds are parallel to the planar fluid collection member and to the planar emitter electrode assembly member.

2. A panel for use in collecting fluid in a gas stream, the panel comprising:
   - a planar fluid collection member comprising one or more collection electrodes; and
   - a planar emitter electrode assembly member comprising one or more emitter electrodes, the planar emitter electrode assembly member attached to the planar fluid collection member by one or more electrically insulating members each comprising one or more sheds,
   - wherein the one or more electrically insulating members are disposed between the planar fluid collection member and the planar emitter electrode assembly member such that the one or more electrically insulating members physically separate the planar fluid collection member and the planar emitter electrode assembly member,
   - wherein the one or more sheds are parallel to the planar fluid collection member and to the planar emitter electrode assembly member.

3. The panel of claim 2, wherein the one or more collection electrodes are each a collection surface that is a mesh or a porous metal plate.

4. The panel of claim 2, wherein the planar fluid collection member comprises a collection frame and the one or more collection electrodes are attached to the collection frame.

5. The panel of claim 4, wherein at least a portion of the collection frame is perforated.

6. The panel of claim 4, comprising one or more rotatable trolley members attached to the collection frame.

7. The panel of claim 2, wherein each of the one or more emitter electrodes is a metal wire.

8. The panel of claim 7, wherein a diameter of the metal wire is from 50 μm to 10 mm.

9. The panel of claim 7, wherein the one or more emitter electrodes are attached to the emitter electrode frame under tension.

10. The panel of claim 9, wherein the one or more emitter electrodes are each entirely under at least 4 N and not more than 20 N of tension.

11. The panel of claim 7, wherein each of the one or more emitter electrodes is wound around at least three electrically insulating capstans.

12. The panel of claim 2, wherein each of the one or more electrically insulating members comprises polytetrafluoroethylene (PTFE).

13. The panel of claim 2, wherein each of the one or more electrically insulating members comprises one or more sheds.

14. The panel of claim 2, comprising:

a second emitter electrode assembly member, the second emitter electrode assembly member comprising a second emitter electrode frame and one or more second emitting electrodes attached to the second emitter electrode frame, wherein the second emitter electrode assembly member is physically attached to, spaced from, and electrically insulated from the fluid collection member by one or more electrically insulating members, wherein the second emitter electrode assembly member is disposed on an opposite side of the fluid collection member from the emitter electrode assembly member such that the fluid collection member is disposed at least partially between the second emitter electrode assembly member and the emitter electrode assembly member.

15. The panel of claim 2, wherein the one or more collection electrodes are grounded.

16. The panel of claim 2, wherein each of the one or more emitter electrodes is a needle.

17. The panel of claim 2, wherein the panel is operable to maintain a voltage of at least 1 kV and no more than 500 kV.

18. The panel of claim 2, wherein the planar fluid collection member and the planar emitter electrode assembly member are separated by no more than 0.5 m.

19. The panel of claim 2, wherein each of the one or more emitter electrodes comprises one or more small radius of curvature points.

20. A panel for use in collecting fluid in a gas stream, the panel comprising:

a planar emitter electrode assembly member comprising one or more tensioned wire electrodes on an emitter electrode frame; and a planar fluid collection member comprising an electrically conductive collection surface wherein the planar emitter electrode assembly member is (i) physically attached to the planar fluid collection member and (ii) disposed apart from and within a distance of no more than 0.5 m of the planar fluid collection member by one or more electrically insulating members each comprising one or more sheds, wherein the one or more sheds are parallel to the planar fluid collection member and to the planar emitter electrode assembly member.

21. The panel of claim 20, wherein each of the one or more tensioned wire electrodes is tensioned around one or more capstans on the emitter electrode frame.

* * * * *